US009546587B2

(12) United States Patent
Kobe et al.

(10) Patent No.: US 9,546,587 B2
(45) Date of Patent: Jan. 17, 2017

(54) COMPONENT OF AN EXHAUST SYSTEM

(71) Applicant: Eberspächer Exhaust Technology GmbH & Co. KG, Neunkirchen (DE)

(72) Inventors: Jürgen Kobe, Nürtingen-Raidwangen (DE); Frank Berkemer, Eningen u.A. (DE); Martin Siring, Sindelfingen (DE); Frank Müller, Esslingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 14/885,105

(22) Filed: Oct. 16, 2015

(65) Prior Publication Data

US 2016/0108792 A1 Apr. 21, 2016

(30) Foreign Application Priority Data

Oct. 17, 2014 (DE) ..... 10 2014 221 151

(51) Int. Cl.

| | |
|---|---|
| ***F01N 1/02*** | (2006.01) |
| ***F01N 13/18*** | (2010.01) |
| ***F01N 13/00*** | (2010.01) |
| ***F01N 13/08*** | (2010.01) |

(Continued)

(52) U.S. Cl.

CPC ..... *F01N 13/007* (2013.01); *F01N 13/082* (2013.01); *F01N 13/10* (2013.01); *F01N 13/1805* (2013.01); *F01N 13/1822* (2013.01); *F01N 13/1827* (2013.01); *F01N 1/00* (2013.01); *F01N 2260/18* (2013.01); *F01N 2450/22* (2013.01); *F01N 2470/02* (2013.01); *F01N 2470/18* (2013.01)

(58) Field of Classification Search

CPC .. F01N 13/1822; F01N 13/18; F01N 13/1805; F01N 13/1838; F01N 1/06; F01N 1/08; F01N 2470/02; B60K 13/04

USPC ..... 181/228, 272, 281, 282, 269, 264, 227; 180/309, 89.2, 296, 68.3; 248/58, 610, 248/613

See application file for complete search history.

(56) References Cited

U.S. PATENT DOCUMENTS 2,395,005 A * 2/1946 Kuhn ..... F01N 1/083 181/255
3,107,748 A * 10/1963 Arthur ..... F01N 13/16 181/245

(Continued)

FOREIGN PATENT DOCUMENTS

DE 10 2005 026 376 A1 12/2006
DE 10 2010 015 322 A1 10/2011

(Continued)

*Primary Examiner* — Edgardo San Martin
(74) *Attorney, Agent, or Firm* — McGlew and Tuttle, P.C.

(57) ABSTRACT

A component (6) of an exhaust system (1) for an internal combustion engine (3), of a motor vehicle, has a housing including a shell (12), two end bottoms (13, 14) and an intermediate bottom (15, 16). The shell (12) encloses an interior space (18) of the housing (11) in a circumferential direction (19). The two end bottoms (13, 14) delimit the interior space (18) in an axial direction (17) at opposite ends and are fixed to the shell (12). The intermediate bottom (15) is arranged in the interior space (18) axially between the end bottoms (13, 14) and is radially supported on the shell (12). A holding pipe (22), for connection of the component (6) to a system periphery (9), is radially held on the intermediate bottom (15) in the interior space (18), passes through one end bottom (13), is fastened thereon and is closed off in a gas-tight manner.

19 Claims, 7 Drawing Sheets

(51) Int. Cl.
*F01N 13/10* (2010.01)
*F01N 1/00* (2006.01)

(56) References Cited

U.S. PATENT DOCUMENTS 3,746,127 A * 7/1973 Leventhal ..... F01N 13/1822 181/243
3,968,854 A * 7/1976 Gordon ..... B60K 13/04 180/68.1
4,192,403 A * 3/1980 Nakagawa ..... F01N 1/089 181/268
4,235,304 A * 11/1980 Suyama ..... F01N 1/02 181/265
4,589,516 A * 5/1986 Inoue ..... F01N 1/10 181/256
4,854,417 A 8/1989 Uesugi et al.
5,477,015 A * 12/1995 Preslicka ..... B21D 39/04 181/243
6,854,561 B2 * 2/2005 Bass ..... B60K 13/04 180/309
7,931,119 B2 * 4/2011 Fujita ..... B60K 13/04 180/309
8,051,949 B2 * 11/2011 Henke ..... F01N 1/08 181/212
8,205,716 B2 * 6/2012 Wirth ..... F01N 1/08 181/212
8,292,026 B2 * 10/2012 Tauschek ..... F01N 1/08 181/212
8,297,048 B2 * 10/2012 Biedler ..... F01N 3/28 60/299
2004/0262460 A1 * 12/2004 Molnar ..... B60K 13/04 248/60
2015/0053501 A1 * 2/2015 Carr ..... F01N 1/086 181/268

FOREIGN PATENT DOCUMENTS

DE 10 2011 077183 A1 12/2012
EP 1 975 380 A1 10/2008
FR 2 797 298 A1 2/2001
JP 2010-255 520 A 11/2010

* cited by examiner

COMPONENT OF AN EXHAUST SYSTEM

CROSS REFERENCE TO RELATED APPLICATIONS

This application claims the benefit of priority under 35 U.S.C. §119 of German Patent Application 10 2014 221 151.4 filed Oct. 17, 2014, the entire contents of which are incorporated herein by reference.

FIELD OF THE INVENTION

The present invention relates to a component of an exhaust system for an internal combustion engine, in particular of a motor vehicle, with the features of the preamble of claim 1. The invention additionally relates to an exhaust system that is equipped with at least one such component.

BACKGROUND OF THE INVENTION

From DE 10 2011 077 183 A1 such an exhaust system component in the form of a silencer is known. Such a generic component comprises a housing, which comprises a shell, two end bottoms and at least one intermediate bottom. The shell encloses an interior space of the housing in a circumferential direction, while the two end bottoms delimit the interior space on opposite ends in an axial direction and are connected to the shell in a fixed manner. The intermediate bottom is axially arranged between the end bottoms in the interior space and is radially supported on the shell.

For holding an exhaust system on a periphery (an environment) of the exhaust system, for example on an underbody of a motor vehicle, holders are employed which are connected in a fixed manner on the one end to a structure of the periphery of the exhaust system and on the other end to a structure of the exhaust system. Depending on the installation situation it can also be required that there be a fastening, at least one such holder to a component of the type mentioned above. In this case, it is possible, in principle, to fasten a corresponding holding body of the holder to the housing of the component. Preferably, welded connections are employed in this case. For example, said holding body can be welded to the shell or to one of the end bottoms.

As part of weight saving, the wall thicknesses of sheet metal, with which the shell and the end bottoms are produced, is reduced in the case of such components, as a result of which the respective component becomes lighter. The reduced wall thickness, however, is simultaneously accompanied by reduced stability. During the operation of the exhaust system, in particular in a vehicle, the holding places, via which the exhaust system is held on the periphery, are exposed to high loads. It has been shown that the connection between holding body and housing is exposed to an increased risk of damage. In particular, there is the risk of crack formation in the region of the welded connection on the shell or on the respective end bottom.

SUMMARY OF THE INVENTION

The present invention deals with the problem of providing an improved embodiment for a component of the type mentioned at the outset or for an exhaust system equipped with such, which is characterized in particular in that the possibility of a connection to a periphery of the exhaust system is improved. In particular, the risk of damaging the component during the operation of the exhaust system is to be reduced.

The invention is based on the general idea of creating a holding place on the housing with the help of at least one holding pipe, which makes possible a high force transmission between a holder acting on the holding pipe and the component. To this end, the respective holding pipe is held in the interior space of the housing on said intermediate bottom and passed through one of the end bottoms and fastened thereon. The holding pipe is additionally closed off gas-tight in such a manner that no exhaust gas can escape through the holding pipe into the surroundings of the component. Through the supporting of the holding pipe on two bottoms which are axially spaced from one another, namely on said end bottom and on said intermediate bottom, comparatively large forces can be transmitted to the housing via the holding pipe, without the intermediate bottom or the end bottom being overloaded in the process. Accordingly, a holding place can be made available with the help of the holding pipe on an outside of said end bottom facing away from the interior space, on which a holder for holding the component or the exhaust system on a periphery can act. The risk of damaging the end bottom or the shell is reduced so that reduced wall thicknesses can be readily used for realizing the shell and the respective end bottom.

Preferentially, the respective holding pipe is at least radially held or supported on the respective intermediate bottom. Because of this, bending moments, which are transmitted to the housing by way of a holder acting on the holding pipe, can be particularly favorably supported by the holding pipe on the one side on the respective end bottom and on the other side on the respective intermediate bottom, wherein the forces that occur are relatively small because of the axial distance between end bottom and intermediate bottom. At the same time, a welded connection for example between the holder and the holding pipe is largely relieved of these moments.

In order to be able to transmit large moments between holding pipe and housing, an axial distance between the end bottom, through which the holding pipe is passed, and the intermediate bottom, on which the holding pipe is supported, is comparatively large. For example, this axial distance can amount to at least 50% of a diameter of the housing. Preferably, the distance amounts to at least 100% of the diameter of the housing.

The respective holding pipe thus serves for fastening a holder on the housing, with which the component can be connected to the periphery of the exhaust system. The holding pipe is gas-tight, so that it does not make possible any gas exchange between the interior space of the housing and the surroundings of the component. At any rate, the holding pipe is neither an inlet pipe, through which the exhaust gas can enter the housing, nor an outlet pipe, through which the exhaust gas can leave the housing.

According to an advantageous embodiment, the end bottom can comprise a bottom aperture, through which the holding pipe is passed and which is enclosed by an annular collar, which is connected to the holding pipe in a gas-tight and fixed manner. Preferably, a welded connection can be employed in this case, for example in the form of a surrounding weld seam, in order to simultaneously realize fixing and sealing. Alternatively, a soldered connection or a glued connection can likewise be employed in this case. The use of an annular collar, which is projected out from the respective end bottom, so-called "rim" or so-called "bell", improves the force transmission between holding pipe and end bottom so that greater forces can be transmitted.

In another embodiment, a holder for connecting the component to a periphery of the exhaust system can be fastened on the holding pipe on an outside of the respective end bottom facing away from the interior space. In this case, the holder is part of the scope of construction of the component, which simplified proper fixing of the holder on the component.

In an advantageous further development, the holder can comprise a pipe body which is axially plugged with the holding pipe and connected to the holding pipe in a fixed manner. This results in a particularly simple assembly which via the axial plug region additionally makes possible great force and moment transmission between pipe body and holding pipe. In this case, the pipe body can be plugged into the holding pipe. Likewise, the pipe body may be plugged onto the holding pipe. In the case of the pipe body being plugged into the holding pipe, the holding pipe can end in the region of the bottom aperture. In the case of the pipe body plugged onto the holding pipe, the holding pipe, by contrast, protrudes axially over the end bottom. A fixed connection between holding pipe and pipe body can be realized in a particularly simple manner for example by way of a suitable press fit. However, a welded connection is preferred for a simplified assembly. Alternatively, a soldered connection or a glued connection may be provided.

In another advantageous further development, the pipe body, the holding pipe and the annular collar can be fastened to one another by means of a common weld seam. Because of this, the components with attached holder can be realized in a particularly simple and cost-effective manner.

According to another advantageous embodiment, the holding pipe can comprise a stepped cross section, wherein the holding pipe in the region of the end bottom has a larger cross section than in the region of the intermediate bottom. The stepped holding pipe can be particularly easily assembled. For example, the holding pipe can be inserted into the housing through the bottom aperture.

In another advantageous further development, the pipe body can be plugged into the holding pipe, wherein a annular step of the holding pipe, which separates two regions of different cross sections from one another, serves as axial stop for limiting the plug-in depth of the pipe body. The stepped design of the holding pipe is thereby given an additional function which simplifies the production of the component with holder.

In another embodiment, the holder can comprise a holding arm which comprises a holder aperture, into which the holding pipe is plugged, wherein the holding arm in the region of the holding aperture is fastened to the holding pipe. Possible fastening methods that are suitable are again a welded connection, a soldered connection or a glued connection, while a welded connection is also preferred in this case. With this design, the holding pipe axially protrudes over the respective end bottom so that on the outside of the same, the holding arm can be plugged onto the holding pipe. Nevertheless, such an arrangement is a comparatively compact construction and makes possible a large force transmission between holder and housing, namely via the holding pipe.

In the case of an advantageous further development, the holding arm can be a hollow body and comprise two walls running in parallel, which are preferentially connected to one another in a fixed manner and each of which has a wall aperture, which jointly form the holder aperture, wherein the holding pipe is connected to both walls in a fixed manner. This results in a particularly light and cost-effectively realizable design for the holder, while great forces can nevertheless be transmitted.

The holding arm, for example, is a shaped sheet metal part, which is produced from a single piece of sheet metal by forming. Alternatively to this, the holding arm can also be a shell body, i.e. be produced from two or more shells. Preferably, the holding arm is produced in a two-shell manner, so that two shells are provided, which each comprise one of the walls and which can be fastened to one another in a suitable manner, for example by means of welded connections.

The walls can comprise rims, which in each case form an annular collar enclosing the associated wall aperture, which improves the force transmission between holding pipe and wall. Surrounding weld seams can then be also produced more easily.

In another embodiment, the holding pipe can be fastened on the intermediate bottom on a side facing the respective end bottom. Because of this, the holding pipe is not only supported radially but also axially on the intermediate bottom, which improves the structural integration of the holding pipe in the housing.

With an alternative design, the holding pipe can penetrate the intermediate bottom in a corresponding bottom aperture and be radially supported on an aperture edge. With this design, the holding pipe penetrates the intermediate bottom. This can simplify the production, in particular when the holding pipe is loosely supported on the intermediate bottom for forming a sliding fit, so that axial relative movements between holding pipe and intermediate bottom are possible, for example for reducing thermally induced stresses.

According to another embodiment, the holding pipe can comprise a closure which closes off the holding pipe in a gas-tight manner. The closure in this case preferably represents a component that is separate with respect to the holding pipe, which is subsequently attached to the holding pipe or installed in the holding pipe. Through the gas-tight closing-off of the holding pipe it is achieved that no gas exchange between the interior and surroundings of the housing can take place through the holding pipe.

Here, the closure can be configured in principle as separating wall, which is inserted in the holding pipe in the region of an axial end of the holding pipe and is connected to the holding pipe in a gas-tight manner. The separating wall, in this case, can be arranged in principle in any position between the end of the holding pipe located inside and the end of the holding pipe located outside, wherein in addition positioning on the end located inside and positioning on the end located outside are also possible. Provided that the separating wall is arranged on one of the axial ends of the holding pipe, the holding pipe encloses a hollow space, which is open either only towards the interior space or only open towards the surroundings of the housing. When the separating wall, by contrast, is axially arranged between the axial ends of the holding pipe, the separating wall simultaneously brings about a sub-division of the hollow space of the holding pipe into an inner section communicating with the interior space and an outer section communicating with the surroundings of the housing. The hollow space that is open towards the interior space respective the inner section that is open towards the inner space can be additionally equipped, in a preferred embodiment, with a gas conducting function and/or with a sound transmission function. For example, the holding pipe can comprise a perforation, as a result of which said hollow space of the holding pipe or said inner section of the holding pipe is connected with a first chamber enveloping the holding pipe. This first chamber can be separated from a second chamber for example by the intermediate bottom. The open inner end of the holding pipe can be connected with the second space through the intermediate bottom. Accordingly, a connection between the two chambers can be established through the holding pipe, for example in order to make possible a suitable gas flow and/or in order to bring about a certain sound transmission. For example, the first chamber can be a resonance chamber or an absorption chamber.

However, an embodiment is preferred, in which the closure is configured as a cap, which is plugged onto an axial end of the holding pipe. This results in a particularly simple producability for the holding pipe that is closed off in a gas-tight manner. Furthermore, an embodiment is preferred, in which the holding pipe does not have any gas-conducting and/or sound transmission effect. In this case, the holding pipe can be particularly easily integrated in existing concepts of such a component.

For example, the cap can be arranged on the holding pipe in the region of the end bottom that is penetrated by the holding pipe so that the hollow space in the interior of the housing enclosed by the holding pipe is open. In this case, there may be a specific matching of the holding pipe as resonance silencer, for example in the form of a $\lambda/2$-pipe or in the form of a $\lambda/4$-pipe.

According to another advantageous further development, the cap can be arranged on the holding pipe in the region of the intermediate bottom and be connected in a fixed manner to the intermediate bottom and to the holding pipe. With this design, fixing the holding pipe on the intermediate bottom is not carried out directly but indirectly, namely via the cap. In particular, the fixing of the holding pipe on the intermediate bottom can thereby be substantially simplified. In particular, there may be a separate production of the holding pipe with cap and installation of this assembly consisting of holding pipe and cap in the housing later on. Practically, this assembly can be tested for its gas-tightness prior to its installation in the housing, as a result of which a high functional safety for the respective component is obtained. The fixing between the assembly and the intermediate bottom can be created particularly easily for example by means of a spot weld, which connects the intermediate bottom to the cap in a fixed manner.

Furthermore there may be a positive connection in radial direction between intermediate bottom and holding pipe or between intermediate bottom and cap. For example, the intermediate bottom for this purpose can have a depression that is formed complementarily to the axial face end of the holding pipe or complementarily to the cap, so that a surrounding edge enclosing the depression makes possible positively joined radial supporting of the holding pipe on the intermediate bottom. At least with the help of such a depression, centering or positioning during the assembly can be brought about. In the region of this depression, an aperture can be formed in the intermediate bottom as a result of which a hollow space that is enclosed by the holding pipe is connected to a chamber of the housing, which is arranged on the intermediate bottom on a side facing away from the holding pipe, when the holding pipe terminates open in the depression.

This component is preferably a silencer. Alternatively, the component can also be a catalytic converter or a particle filter. In principle, combined components may also be provided when in a common housing at least two members from the group of silencer, catalytic converter and particle filter are arranged.

An exhaust system according to the invention comprises at least one exhaust line, which on the inlet side comprises at least one exhaust manifold and on the outlet side comprises at least one end pipe. Furthermore, the exhaust system comprises at least one component of the type described above, which is arranged in the exhaust line.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
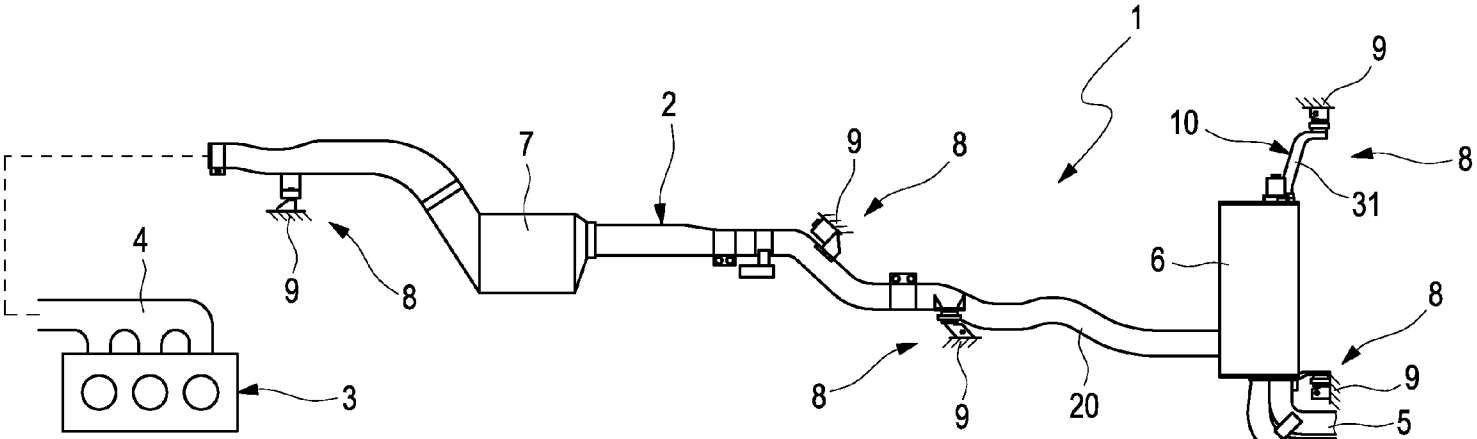
FIG. 1 is a schematic simplified view of an exhaust system showing one of different embodiments.
Figure 2:
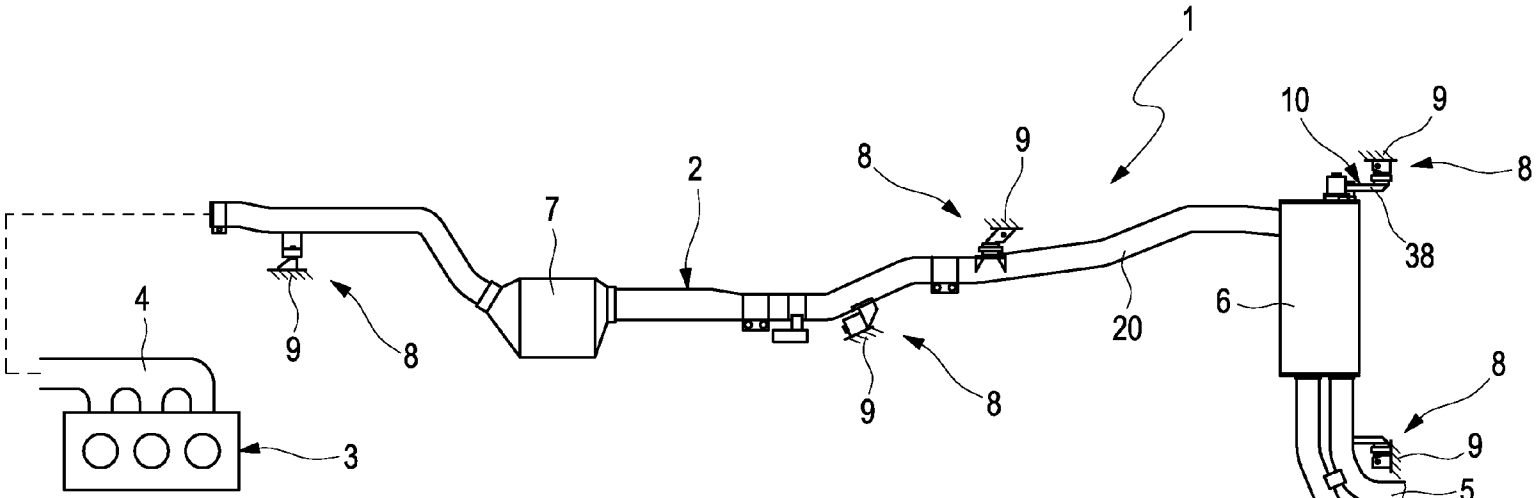
FIG. 2 is a schematic simplified view of an exhaust system showing another of different embodiments.

Referring to the drawings, according to the FIGS. 1 and 2, an exhaust system 1 comprises at least one exhaust line 2. The exhaust system 1 in this case serves for discharging combustion exhaust gas, exhaust gas in brief, from an internal combustion engine 3, which can in particular be arranged in a motor vehicle. The exhaust line 2 in this case is equipped on the inlet side with at least one exhaust manifold 4 and on the outlet side with at least one tailpipe 5. The exhaust system 1 is additionally equipped with at least one component 6, which is explained in more detail in the following by way of the FIGS. 3 to 14. In the example introduced herein, this component 6 is configured as a silencer, preferentially as an end silencer, so that the component 6 in the following can also be called silencer 6. In principle, such a component 6 can also be formed as a particle filter or as a catalytic converter or of any combination of at least one catalytic converter, at least one particle filter and at least one silencer. In the section of the exhaust system 1 shown in the FIGS. 1 and 2, the exhaust line 2 includes a further component 7, which is configured as a silencer or catalytic converter or particle filter. The respective component 6, 7 is arranged in the exhaust line 2, i.e. incorporated therein with respect to the exhaust gas routing.

The exhaust system 1 or its exhaust line 2 is connected to a periphery 9 of the exhaust system 1 by way of multiple holding places 8. In the case of a vehicle application, the exhaust system 1 is suspended from an under body of the vehicle via the holding places 8, which in this case forms the periphery 9 of the exhaust system 1. According to the embodiments of the FIGS. 1 and 2, at least one of these holding places 8 is formed with help of a holder 10, which is connected in a fixed manner to the aforementioned component 6 or the silencer 6. This holder 10 is exposed to particularly high loads since the silencer 6 has a comparatively great mass.

According to the FIGS. 3 to 14, the component 6, which is preferably configured as a silencer 6, comprises a housing 11, which comprises a shell 12, two end bottoms 13, 14 and at least one intermediate bottom 15. In the FIGS. 5 to 8, 10 and 11, the respective intermediate bottom 15 is noticeable. In the embodiment shown in FIG. 5, only a single intermediate bottom 15 is provided. In the embodiments shown in the FIGS. 6 and 8, a further intermediate bottom 16 is provided in addition to the intermediate bottom 15. In principle, more than two intermediate bottoms 15, 16 can also be present.

The housing 11 in this case is configured substantially cylindrically, as a result of which it defines a longitudinal axis or axial direction 17, which in the figures is indicated by a double arrow. The shell 12 encloses an interior space 18 of the housing 11 in a circumferential direction 19, which in the FIGS. 5, 7 and 12 to 14 is indicated in each case by a double arrow. The circumferential direction 19 in this case relates to the axial direction 17 respectively to the longitudinal centre axis of the housing 11 which is not shown here. The two end bottoms 13, 14 are arranged on both face ends of the housing 11, so that they delimit the interior space 18 in the axial direction 17 at opposite ends. Furthermore, the two end bottoms 13, 14 are each connected to the shell 12 in a fixed manner. Suitable connection techniques are for example a flanged connection. Preferably, the end bottoms 13, 14 however are welded to the shell 12. The respective intermediate bottom 15, 16 is axially arranged between the end bottoms 13, 14 and additionally spaced from the respective end bottom 13, 14 in the axial direction 17. Furthermore, the respective intermediate bottom 15, 16 is radially supported on the shell 12. In this case, the respective intermediate bottom 15, 16 on the shell 12, for example by means of spot welds. In principle, however, there may be a loose arrangement of the intermediate bottom 15, 16 on the shell 12.

The intermediate bottom 15 is positioned spaced from both end bottoms 13, 14 in the axial direction 17. According to FIG. 10, the intermediate bottom 15 has an axial distance A from the end bottom 13, which in the example is approximately identical in size as a diameter D of the housing 11, which the housing 11 has transversely to the axial direction 17 in a region between the intermediate bottom 15 and the end bottom 13.

In the case of the show embodiments, an exhaust gas pipe 20 of the exhaust line 2 feeds exhaust gas to the component 6 during the operation of the exhaust system 1. A pipe arrangement 21 in the interior space 18 of the housing 11 feeds the exhaust gas to the two end pipes 5, which are connected to the housing on the outlet side. In the shown examples, the exhaust pipe 20 is connected to the shell 12, while the end pipes 5 are connected to one of the two end bottoms 13, 14.

The component 6 introduced is additionally equipped with at least one holding pipe 22, which is noticeable in the FIGS. 5 to 13. The holding pipe 22 is in the interior space 18 is radially held on the intermediate bottom 15. Furthermore, the holding pipe 22 is passed through one of the end bottoms 13, 14 and fastened thereon. In addition, the holding pipe 22 is closed off in a gas-tight manner. Accordingly, the holding pipe 22 is supported in an outer region 23, that is in the region of an outer end 24 of the holding pipe 22 that is proximal with respect to the end bottom 13 penetrated by the holding pipe 22, on said end bottom 13, while in an inner region 25, that is in the region of an inner end 26 of the holding pipe 22 that is distal with respect to the end bottom 13 penetrated by the holding pipe 22 it is supported on the intermediate bottom 15. The two support regions 23, 25 are spaced from one another in the axial direction 17, as a result of which the holding pipe 22 can support comparatively high bending moments on the housing 11.

As is evident in particular from the FIGS. 10 to 14, the end bottom 13 concerned has a bottom aperture 27, which is enclosed by an annular collar 28. The holding pipe 22 is passed through the bottom aperture 27, wherein it is connected to the annular collar 28 in a gas-tight and fixed manner. Preferably, a welded connection is employed in this case.

Figure 12:
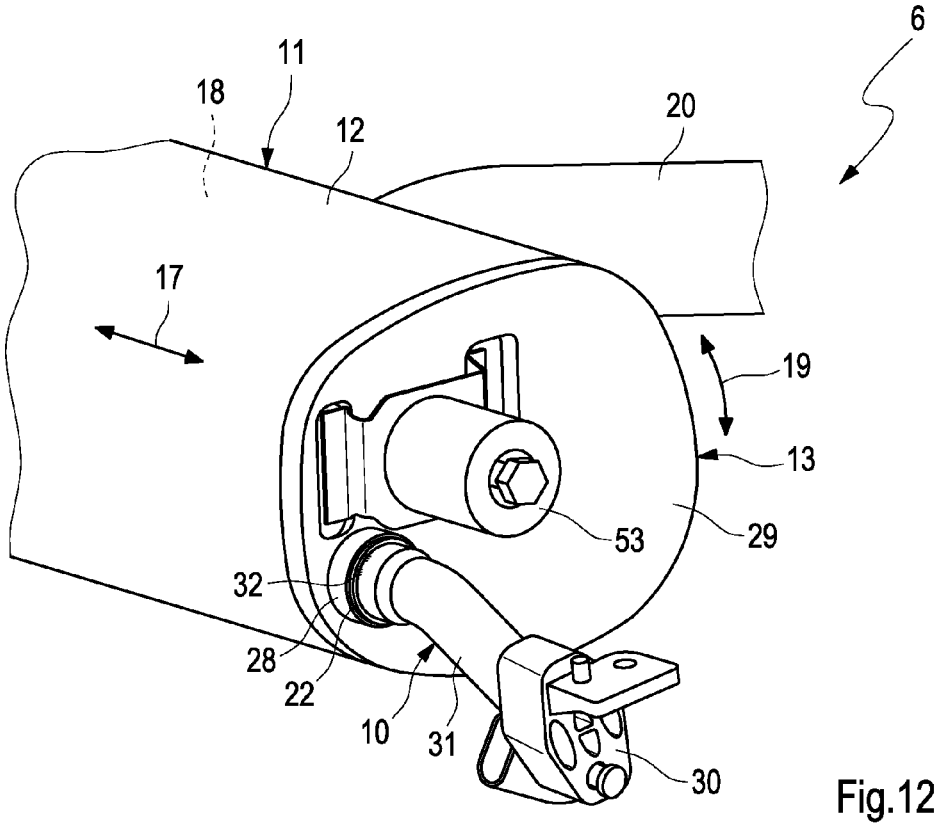
FIG. 12 is a schematic isometric view of the silencer in the region of a holder.
Figure 13:
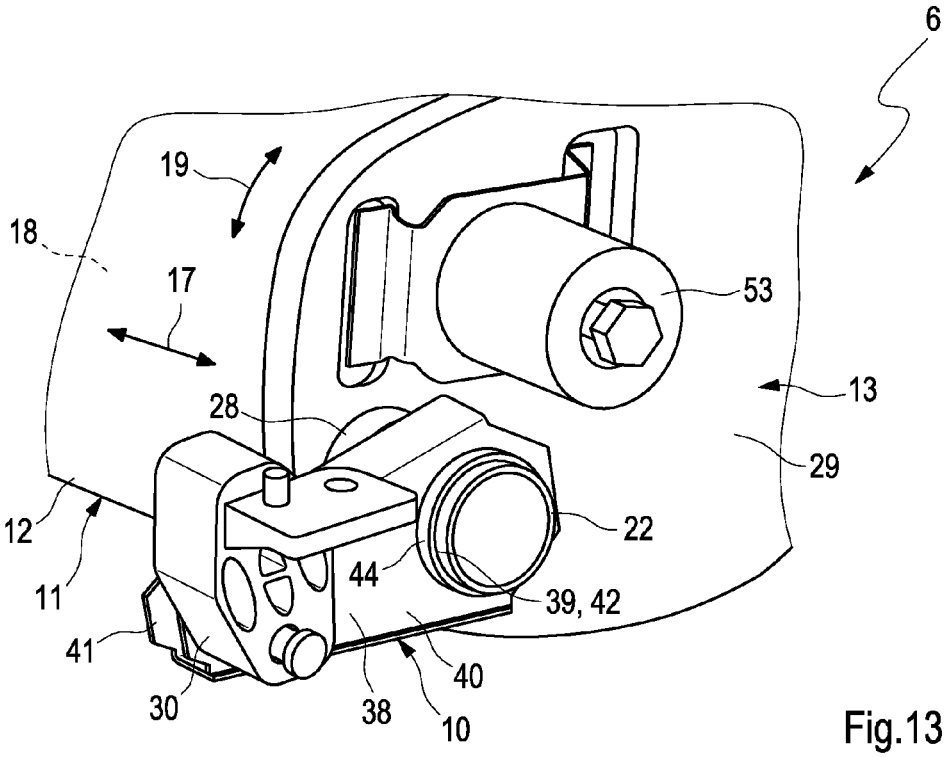
FIG. 13 is a schematic isometric view of the silencer in the region of the holder, however with another embodiment.
Figure 14:
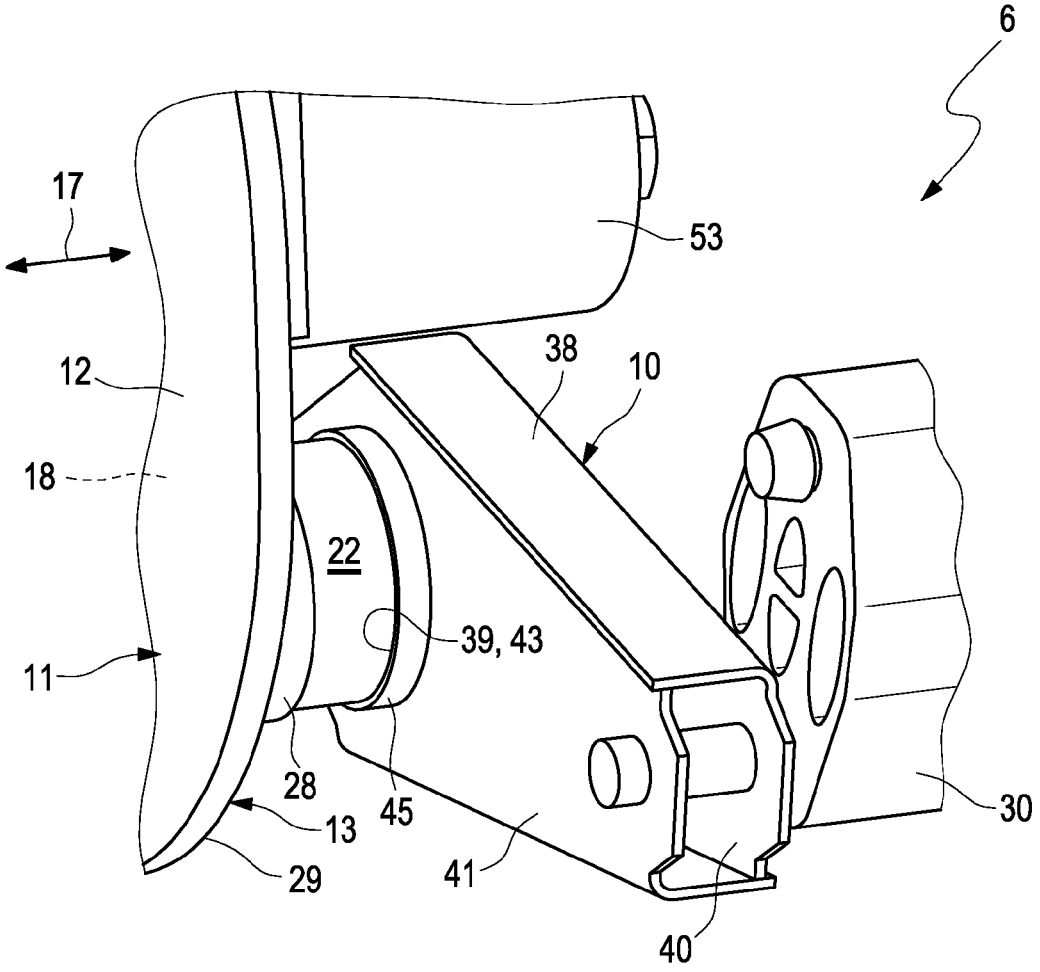
FIG. 14 is a schematic isometric view as in FIG. 13, however in another viewing direction.

As is evident in the FIGS. 1 to 4 in principle and in detail in the FIGS. 12 to 14, such a holder 10 is fastened to the holding pipe 22 on an outside 29 of the associated end bottom 13. Via the holder 10, the component 6 can be connected to the periphery 9 of the exhaust system 1 in a fixed manner. The holder 10, in this case, can be equipped in the usual manner with an elastomer bearing 30 according to the FIGS. 12 to 14. The outside 29 of the end bottom 13 in this case faces away from the interior space 18.

Figure 3:
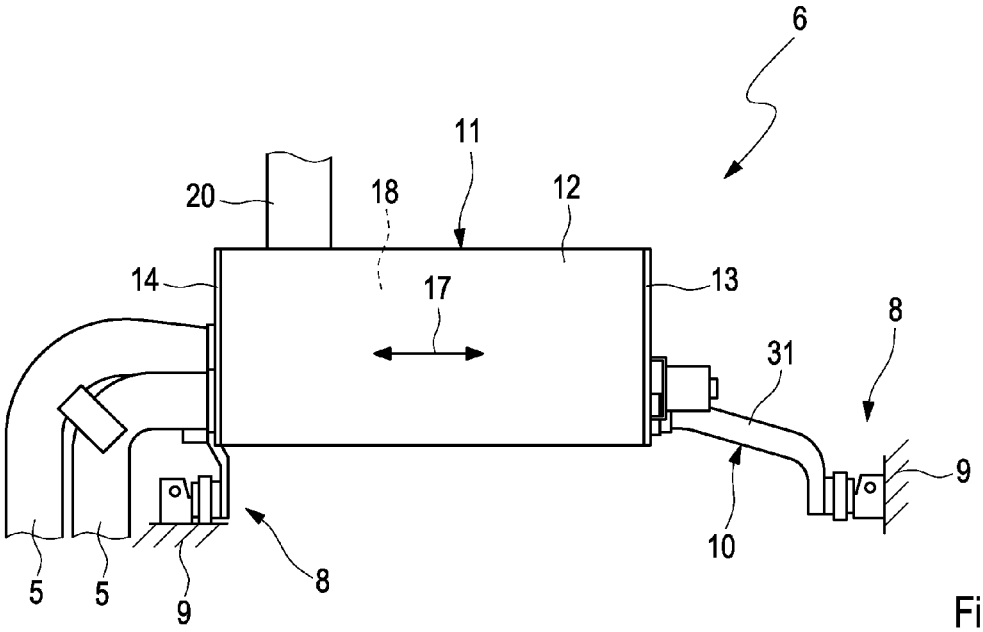
FIG. 3 is a schematic enlarged view of the exhaust system from FIG. 1, in the region of a silencer.
Figure 4:
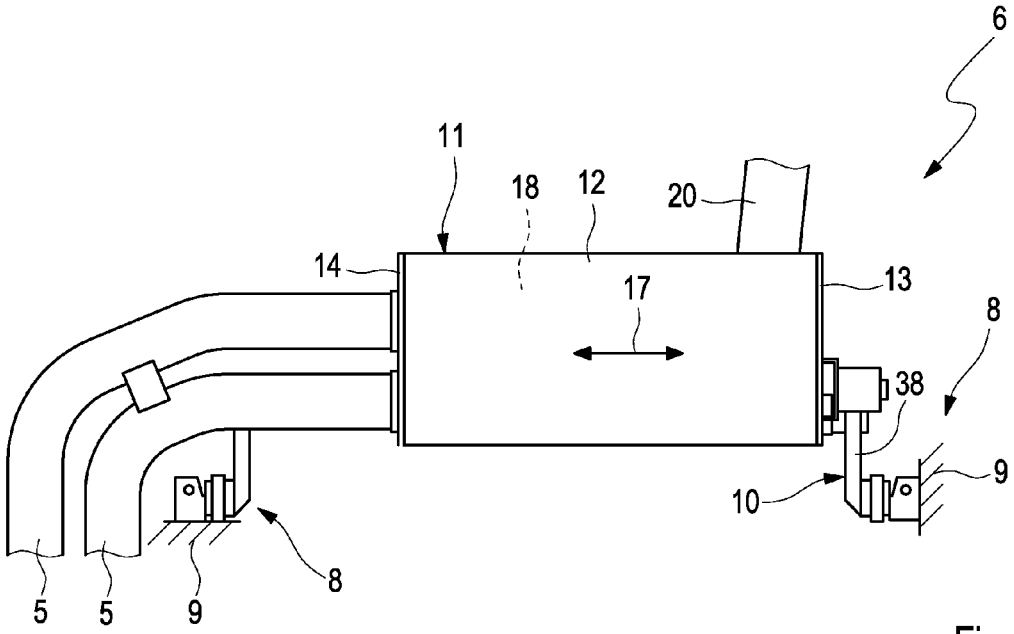
FIG. 4 is a schematic enlarged view of the exhaust system from FIG. 1, in the region of a silencer.
Figure 5:
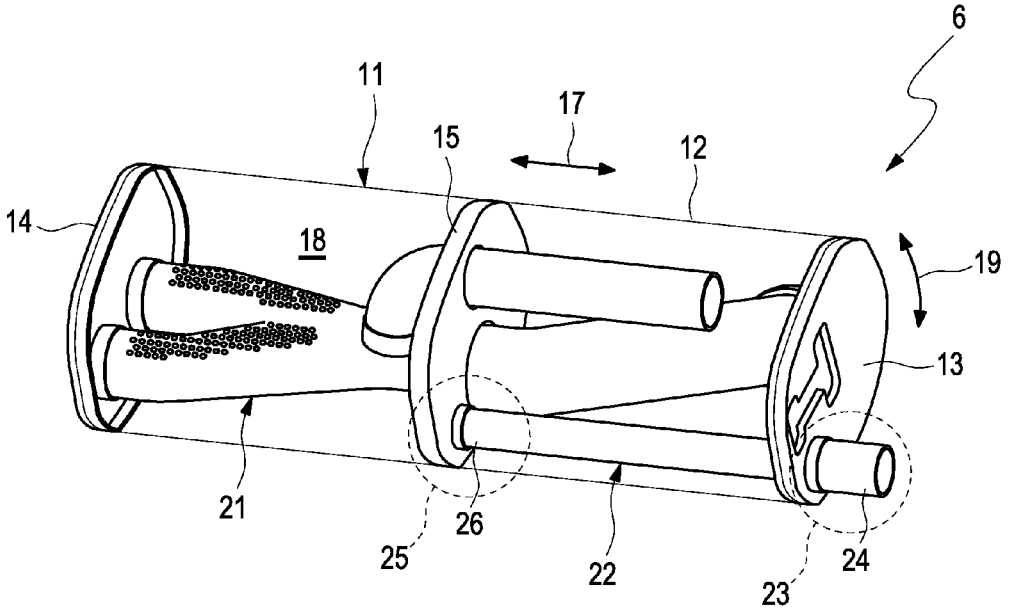
FIG. 5 is a schematic isometric view of the silencer with transparent shell of one of different embodiments.
Figure 6:
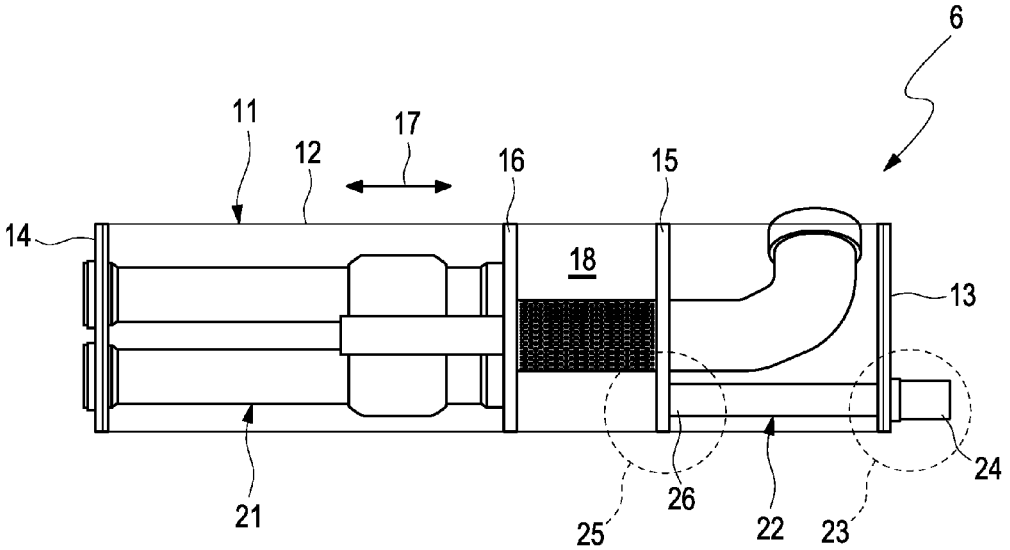
FIG. 6 is a schematic isometric view of the silencer with transparent shell of one of different embodiments.
Figure 7:
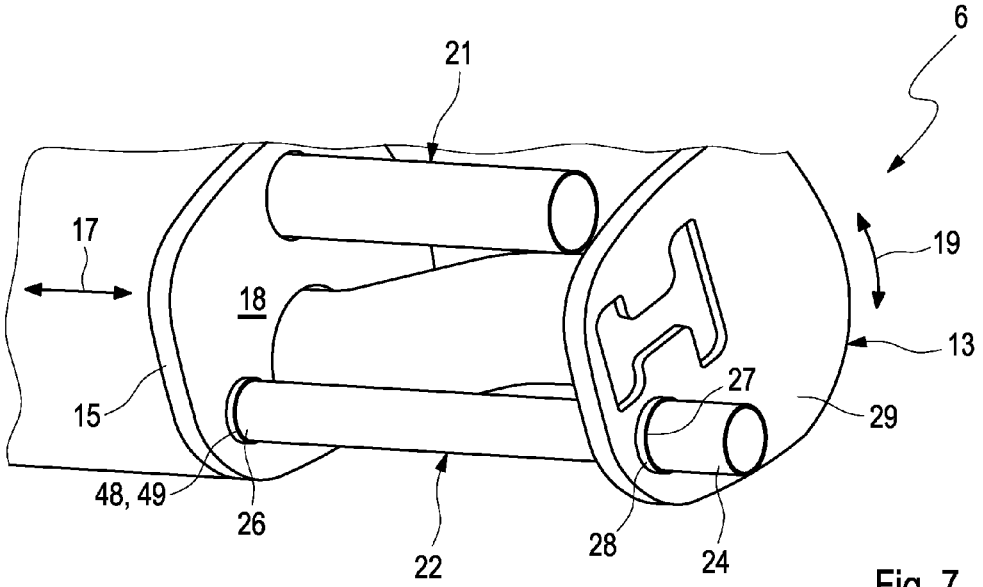
FIG. 7 is a schematic isometric view of the silencer in the region of a holding pipe with absent shell.
Figure 8:
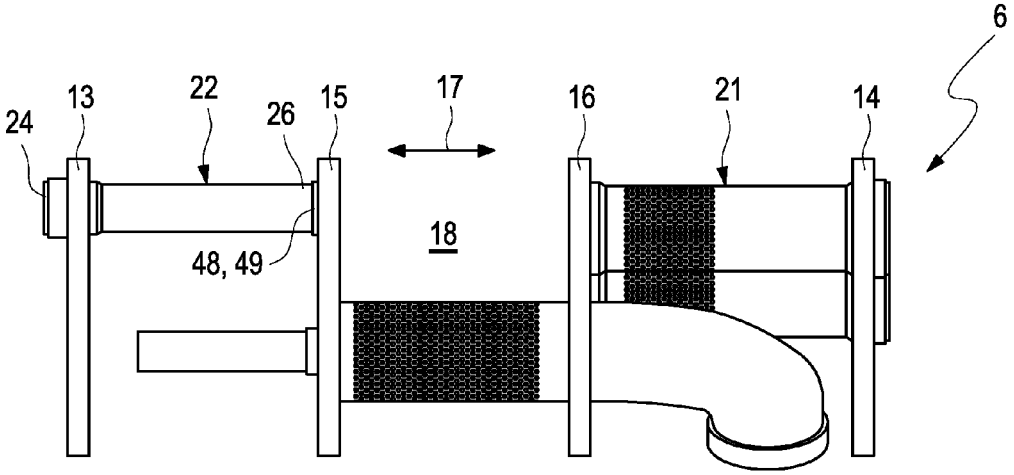
FIG. 8 is a schematic lateral view of the silencer with absent shell.
Figure 9:
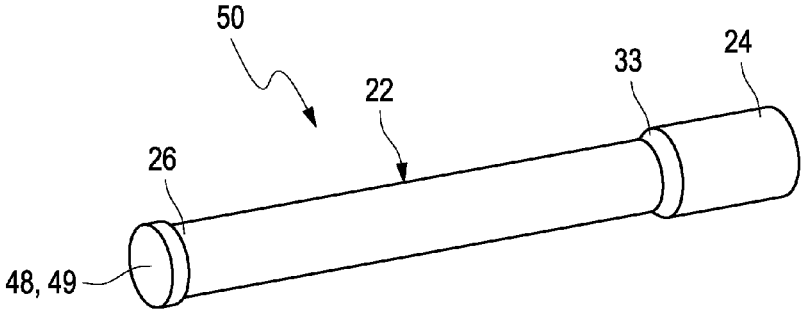
FIG. 9 is a schematic isometric view of the holding pipe.

In the embodiment shown in FIGS. 1, 3 and 12, the holder 10 is equipped with a pipe body 31, which is axially plugged with the holding pipe 22. Preferably, the pipe body 31 is axially plugged into the holding pipe 22. Furthermore, the pipe body 31 is connected to the holding pipe 22 in a fixed manner. To this end, a common, closed circumferential weld seam 32 can be provided, which is indicated in FIG. 12 only in the region of a circumferential segment. With the help of the common weld seam 32, pipe body 31, holding pipe 22 and annular collar 28 are fastened to one another. In other words, the weld seam 32 connects, on the one hand, the holding pipe 22 to the annular collar 28 and, on the other hand, the pipe body 31 to the holding pipe 22. In the example of the FIGS. 1, 3, 10 and 12, the holding pipe 22 ends in the region of the annular collar 28, wherein it axially protrudes over the annular collar 28 only so far that said weld seam 32 can be produced without problems.

Figure 10:
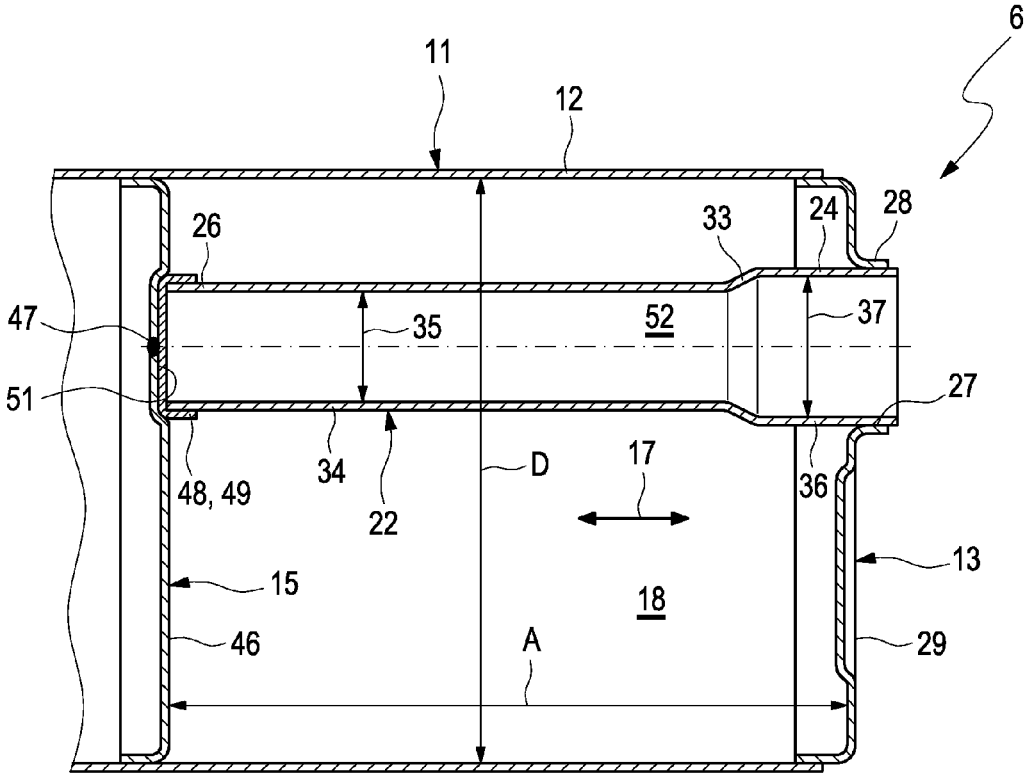
FIG. 10 is a schematic longitudinal section of the silencer in the region of the holding pipe.
Figure 11:
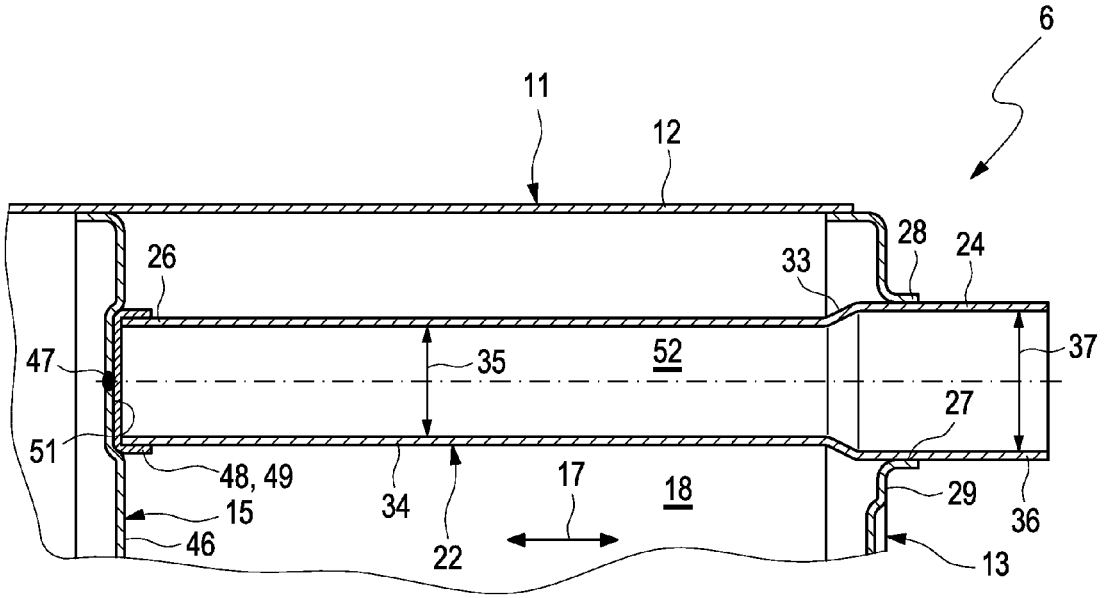
FIG. 11 is a schematic half longitudinal section of the silencer in the region of the holding pipe, however with another embodiment.

According to the FIGS. 10 and 11, the holding pipe 22 has a step cross section, wherein the holding pipe 22 in the shown examples only has a single annular step 33 each. The annular step 33 in this case forms the transition between a first section 34, which has a first cross section 35, and a second longitudinal section 36, which has a second cross section 37. The first longitudinal section 34 in this case is arranged distally with respect to the end bottom 13 penetrated by the holding pipe 22, while the second longitudinal section 36 with respect to this end bottom 13 is arranged proximally. Evidently, the first longitudinal section 34 has a smaller cross section than the second longitudinal section 36. In other words, the second cross section 37 is larger than the first cross section 35. In this respect, the holding pipe 22 has a larger cross section in the region of the end bottom 13 than in the region of the intermediate bottom 15.

Practically, the pipe body 31 of the holder 10 can now be matched to the holding pipe 22 in such a manner that it can be axially plugged into the same, wherein in addition the annular step 33 serves as axial stops for limiting the plug-in depth of the pipe body 31. In this regard, a simplified production for the component 6 is obtained in this case.

In the embodiment shown in the FIGS. 2, 4, 13 and 14, the holder 10 comprises a holding arm 38, which comprises a holder aperture 39, into which the holding pipe 22 is plugged. For this purpose, the holding pipe 22 according to the FIGS. 5 to 7, 11, 13 and 14, axially protrudes over said end bottom 13. The holding arm 38 can then be fastened to the holding pipe 22 in a suitable manner in the region of the holder aperture 39. Welded connections are again particularly suitable for this purpose.

Preferably, the holding arm 38 is a hollow body which is characterized by a low weight. Because of this, the holding arm 38 has two walls 40 and 41 running in parallel, which are preferentially connected to one another in a fixed manner. The one wall 40 faces the beholder in FIG. 13. The other wall 41 faces the beholder in FIG. 14. Each wall 40, 41 comprises a wall aperture 42 respectively 43, which are axially aligned with one another and jointly form the holder aperture 39. Accordingly, the holding pipe 22 is plugged in through both wall apertures 42, 43 and in the region of the respective wall aperture 42, 43 is connected to the respective wall 40, 41 in a fixed manner. Accordingly, the holding pipe 22 is connected to both walls 40, 41 in a fixed manner.

In the shown example, the holding arm 38 is designed two-shelled, so that it has two shells, each of which being formed by angled sheet metal pieces and each of which comprises one of the walls 40, 41. The two shells in this case can be connected to one another in a fixed manner by means of suitable weld seams. The respective wall 40, 41 each has a rim 44 and 45 respectively in the region of the receptive wall aperture 42, 43, which forms an annular enclosure for the receptive wall aperture 42, 43. Along this rim 44, 45, the respective wall 40, 41 can be connected to the holding pipe 22 through suitable weld seams or welds which are not shown here.

As is evident in particular in the FIGS. 10 and 11, the holding pipe 22 can be fastened to the intermediate bottom 15 on a side 46 of the intermediate bottom 15 facing the respective end bottom 13, for example by means of a spot weld 47. This produces an axial and radial support of the holding pipe 22 on the intermediate bottom 15.

The holding pipe 22 is equipped with a closure 48, which closes off the holding pipe 22 in a gas-tight manner. In the examples of the FIGS. 7 to 11, the closure 48 is configured as a cap 49, which is plugged onto the inner end 26 of the holding pipe 22. Furthermore, the cap is connected to the holding pipe 22 in a gas-tight, fixed and suitable manner. For example, the cap 49 can be soldered to the holding pipe 22. However, a welded connection is also preferred in this case. Realizing the closure 48 in the form of a cap 49, which can be plugged onto the end 26 of the holding pipe 22 located inside, simplifies the production of an assembly 50 that is separately shown in FIG. 9, which is formed out of the holding pipe 22 and the closure 48. This assembly 50 can be tested for tightness independently of the remaining component 6. Following this, the assembly 50 can be inserted in the housing 11.

As is evident from the FIGS. 7 to 11, the cap 49 is directly fixed on the intermediate bottom 15, while the holding pipe 22 in turn is directly fixed on the cap 49, so that ultimately the holding pipe 22 is not directly fastened to the intermediate bottom 15, but indirectly, namely indirectly to the intermediate bottom 15, namely via the cap 49. This produces a simplified fixing of the holding pipe 22 on the intermediate bottom 15, for example by said spot weld 47. As is evident in the FIGS. 10 and 11, the intermediate bottom 15 can have a depression 51 on its side facing the end bottom 13, which is formed complementarily to the cap 49 and accordingly forms a positioning aid for the cap 49 when inserting the assembly 50.

In the preferred example shown, a hollow space 52 of the holding pipe 22 is completely fluidically separated from the interior space 18 of the housing 11, namely in the circumferential direction by the holding pipe 22 and in the axial direction by the closure 48.

In the FIGS. 12 to 14, a bracket 53 is fastened to the outside 29 of the end bottom 13, via which a vibration absorber that is not shown can be connected to the housing 11. With the help of such a vibration absorber, counter vibrations can be generated in the region of resonance frequencies which lead to significant vibration damping.

While specific embodiments of the invention have been shown and described in detail to illustrate the application of the principles of the invention, it will be understood that the invention may be embodied otherwise without departing from such principles.

What is claimed is:

1. An exhaust system component for an internal combustion engine of a motor vehicle, the exhaust system component comprising:

a housing comprising a shell, two end bottoms and at least one intermediate bottom, wherein:

the shell encloses an interior space of the housing in a circumferential direction;

the two end bottoms are connected to the shell in a fixed manner and delimit the interior space in an axial direction, at opposite ends; and the intermediate bottom is arranged in the interior space, axially between the end bottoms, and radially supported on the shell; and at least one holding pipe with an end disposed in the interior space and which holding pipe is held on the intermediate bottom in the interior space, the at least one holding pipe being passed through only one of the two end bottoms in a pass through region and extending outwardly of the one of the two end bottoms and being fastened on the one of the two end bottoms, the one of the two end bottoms being closed off in a gas-tight manner in the pass through region and the holding pipe being closed gas-tight relative to the interior space.

2. An exhaust system component according to claim 1, further comprising an annular collar wherein the one of the two end bottoms comprises a bottom aperture, through which the holding pipe is passed and which is enclosed by the annular collar, the annular collar being connected to the holding pipe in a gas-tight and fixed manner.

3. An exhaust system component for an internal combustion engine of a motor vehicle, the exhaust system component comprising:

a housing comprising a shell, two end bottoms and at least one intermediate bottom, wherein:

the shell encloses an interior space of the housing in a circumferential direction;

the two end bottoms are connected to the shell in a fixed manner and delimit the interior space in an axial direction, at opposite ends; and the intermediate bottom is arranged in the interior space, axially between the end bottoms, and radially supported on the shell;

at least one holding pipe which is held on the intermediate bottom in the interior space, the at least one holding pipe being passed through one of the two end bottoms in a pass through region and being fastened on the one of the two end bottoms, the one of the two end bottoms being closed off in a gas-tight manner in the pass through region; and a holder for connecting the component to a periphery of the exhaust system, wherein the holder is fastened to the holding pipe, on an outside of the one of the two end bottoms, facing away from the interior space.

4. An exhaust system component according to claim 3, wherein the holder comprises a pipe body, which is axially plugged with the holding pipe and is connected to the holding pipe in a fixed manner.

5. An exhaust system component according to claim 3, further comprising:

an annular collar wherein the one of the two end bottoms comprises a bottom aperture, through which the holding pipe is passed and which is enclosed by the annular collar, the annular collar being connected to the holding pipe in a gas-tight and fixed manner; and a common weld seam, wherein:

the holder comprises a pipe body, which is axially plugged with the holding pipe and is connected to the holding pipe in a fixed manner; and the pipe body, the holding pipe and the annular collar are fastened to one another by the common weld seam.

6. An exhaust system component according to claim 1, wherein:

the holding pipe has a stepped cross section; and the holding pipe, in the region of the one of the two end bottoms, has a larger cross section than in a region of the intermediate bottom.

7. An exhaust system component for an internal combustion engine of a motor vehicle, the exhaust system component comprising:

a housing comprising a shell, two end bottoms and at least one intermediate bottom, wherein:

the shell encloses an interior space of the housing in a circumferential direction;

the two end bottoms are connected to the shell in a fixed manner and delimit the interior space in an axial direction, at opposite ends; and the intermediate bottom is arranged in the interior space, axially between the end bottoms, and radially supported on the shell; and at least one holding pipe which is held on the intermediate bottom in the interior space, the at least one holding pipe being passed through one of the two end bottoms in a pass through region and being fastened on the one of the two end bottoms, the one of the two end bottoms being closed off in a gas-tight manner in the pass through region a holder for connecting the component to a periphery of the exhaust system, wherein:

the holder comprises a pipe body, which is axially plugged with the holding pipe and is connected to the holding pipe in a fixed manner;

the pipe body is plugged into the holding pipe; and an annular step of the holding pipe, which separates two regions of different cross sections from one another, provides an axial stop for limiting a plug-in depth of the pipe body.

8. An exhaust system component according to claim 3, wherein:

the holder comprises a holding arm;

the holding arm comprises a holder aperture, into which the holding pipe is plugged; and the holding arm is fastened to the holding pipe in the region of the holder aperture.

9. An exhaust system component according to claim 8, wherein:

the holding arm is a hollow body and comprises two walls running parallel, which each comprise a wall aperture, which jointly form the holder aperture; and the holding pipe is connected to both walls in a fixed manner.

10. An exhaust system component according to claim 1, wherein the holding pipe is fastened to the intermediate bottom on a side of the intermediate bottom facing the one of the two end bottoms.

11. An exhaust system component according to claim 1, wherein the holding pipe penetrates the intermediate bottom in a corresponding bottom aperture and is radially supported on an aperture edge.

12. An exhaust system component according to claim 1, wherein that the holding pipe comprises a closure, which closes off an interior end of the holding pipe in a gas-tight manner.

13. An exhaust system component according to claim 12, wherein that the closure is configured as a cap, which cap is plugged onto an axial end of the holding pipe.

14. An exhaust system component according to claim 13, wherein that the cap, in a region of the intermediate bottom, is arranged on the holding pipe and is connected in a fixed manner to the intermediate bottom and to the holding pipe.

15. An exhaust system for an internal combustion engine of a motor vehicle, the exhaust system comprising:

an exhaust line with an inlet side comprising at least one exhaust manifold and with an outlet side comprising at least one end pipe; and at least one component comprising:

a housing comprising a shell, two end bottoms and at least one intermediate bottom, wherein:

the shell encloses an interior space of the housing in a circumferential direction;

the two end bottoms are connected to the shell in a fixed manner and delimit the interior space in an axial direction, at opposite ends;

the intermediate bottom is arranged in the interior space, axially between the end bottoms, and radially supported on the shell; and at least one holding pipe which is held on the intermediate bottom in the interior space, the at least one holding pipe being passed through one of the two end bottoms in a pass through region and being fastened on the one of the two end bottoms, the one of the two end bottoms being closed off in a gas-tight manner in the pass through region, wherein the at least one component is arranged in the exhaust line; and a holder for connecting the component to a periphery of the exhaust system, wherein the holder is fastened to the holding pipe, on an outside of the one of the two end bottoms, facing away from the interior space, wherein that the holder comprises a pipe body, which is axially plugged with the holding pipe and is connected to the holding pipe in a fixed manner.

16. An exhaust system component according to claim 15, further comprising:

an annular collar wherein the one of the two end bottoms comprises a bottom aperture, through which the holding pipe is passed and which is enclosed by the annular collar, the annular collar being connected to the holding pipe in a gas-tight and fixed manner; and a common weld seam, wherein the holder comprises a pipe body, which is axially plugged with the holding pipe and is connected to the holding pipe in a fixed manner, wherein:

the pipe body, the holding pipe and the annular collar are fastened to one another by the common weld seam.

17. An exhaust system component according to claim 15, further comprising:

an annular collar wherein the one of the two end bottoms comprises a bottom aperture, through which the holding pipe is passed and which is enclosed by the annular collar, the annular collar being connected to the holding pipe in a gas-tight and fixed manner; and a common weld seam, wherein:

the holder comprises a pipe body, which is axially plugged with the holding pipe and is connected to the holding pipe in a fixed manner; and the pipe body, the holding pipe and the annular collar are fastened to one another by the common weld seam.

18. An exhaust system according to claim 16, wherein:

the holding pipe has a stepped cross section; and the holding pipe, in the region of the one of the two end bottoms, has a larger cross section than in a region of the intermediate bottom, wherein:

the pipe body is plugged into the holding pipe; and an annular step of the holding pipe, which separates two regions of different cross sections from one another, provides an axial stop for limiting a plug-in depth of the pipe body.

19. An exhaust system component according to claim 15, wherein:

the holder comprises a holding arm;

the holding arm comprises a holder aperture, into which the holding pipe is plugged;

the holding arm is fastened to the holding pipe in the region of the holder aperture;

the holding arm is a hollow body and comprises two walls running parallel, which each comprise a wall aperture, which jointly form the holder aperture; and the holding pipe is connected to both walls in a fixed manner.

* * * * *